US006516730B1

(12) United States Patent
Mason

(10) Patent No.: US 6,516,730 B1
(45) Date of Patent: Feb. 11, 2003

(54) CORNER PROTECTOR SYSTEM FOR USE WITH PALLETS

(75) Inventor: Allen Mason, Palm Beach, FL (US)

(73) Assignee: Food Machinery Equipment Corporation, Palm Beach, FL (US)

( * ) Notice: Subject to any disclaimer, the term of this patent is extended or adjusted under 35 U.S.C. 154(b) by 0 days.

(21) Appl. No.: 09/954,084

(22) Filed: Sep. 17, 2001

(51) Int. Cl.[7] ..... B65D 19/44
(52) U.S. Cl. ..... 108/55.1; 108/56.3
(58) Field of Search ..... 108/51.11, 53.5, 108/55.1, 56.1, 56.3

(56) References Cited

U.S. PATENT DOCUMENTS

| | | | | | |
|---|---|---|---|---|---|
| 1,349,500 | A | * | 8/1920 | Dietz | 108/55.1 |
| 3,834,324 | A | * | 9/1974 | Lang | 108/190 |
| 4,201,138 | A | * | 5/1980 | Cox | 108/55.1 |
| 4,292,899 | A | | 10/1981 | Steffen | |
| 4,715,294 | A | | 12/1987 | Depew | |
| 5,076,175 | A | | 12/1991 | Whatley, II | |
| 5,507,237 | A | * | 4/1996 | Barrow et al. | 108/53.1 |
| 5,651,463 | A | * | 7/1997 | Major et al. | 108/53.3 |
| 5,673,629 | A | | 10/1997 | Ginnow | |
| 6,192,807 | B1 | | 2/2001 | Mason | |
| 6,408,770 | B1 | * | 6/2002 | Mason | 108/54.1 |

FOREIGN PATENT DOCUMENTS

| | | | | |
|---|---|---|---|---|
| AT | 212772 | * | 1/1961 | 108/53.5 |

* cited by examiner

*Primary Examiner*—Lanna Mai
*Assistant Examiner*—Jerry A. Anderson
(74) *Attorney, Agent, or Firm*—Caesar, Rivise, Bernstein, Cohen & Pokotilow, Ltd.

(57) ABSTRACT

A corner protector system for use with a pallet protector encircling the periphery of at least one pallet. The corner protector system comprises at least one protector member having a pair of walls disposed generally perpendicularly to each other to form a corner. A right-angle corner shaped channel is provided in the bottom of the corner protector member to releasably accommodate a corner portion of the pallet protector. The corner member extends upward from the pallet protector and the pallet for good visibility to protect persons in the vicinity and to protect merchandise on the pallet.

10 Claims, 4 Drawing Sheets

FIG.4
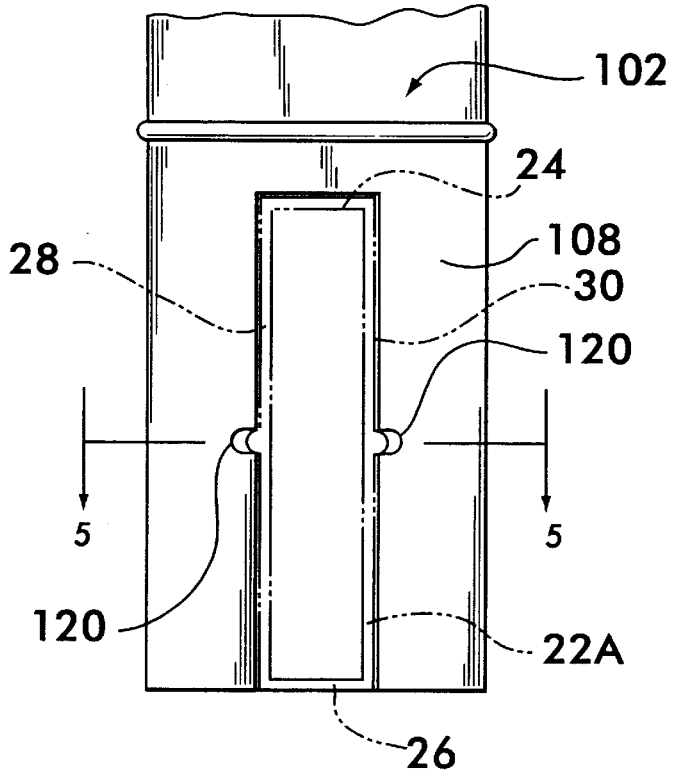
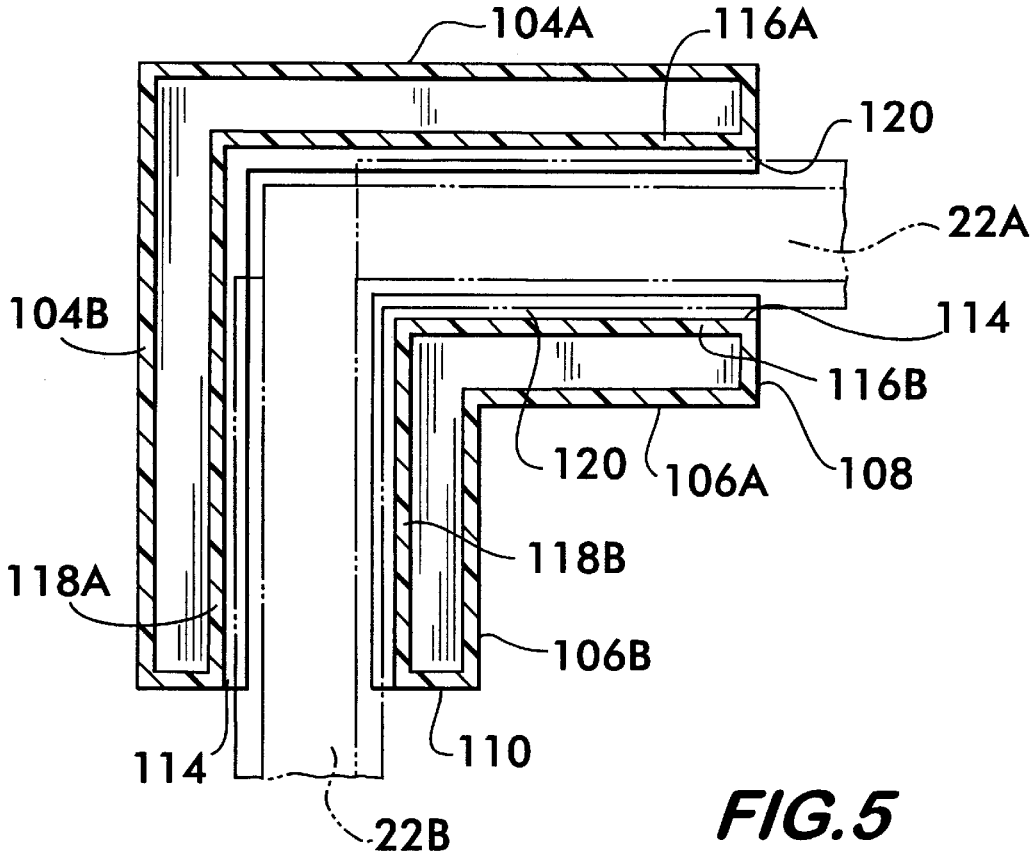
FIG.5

CORNER PROTECTOR SYSTEM FOR USE WITH PALLETS

BACKGROUND OF THE INVENTION

This invention relates generally to pallets for supporting materials, and more particularly to a system of corner protectors for use with a pallet protector assembly for a pallet or plural pallets.

In U.S. Pat. No. 4,715,294 (Depew) there is disclosed a pallet construction making use of protective members fabricated out of metal, plastic or other impact resistant material for engaging two opposed end portions of the pallet to protect against damage. The protective members are in the form of upper and lower elongated bars and associated cap portions. The protective members are arranged to be secured in place to the pallet, via nails or screws, with the bars extending flush with the top and bottom surfaces of the upper and lower deck-boards, and with the cap portions embracing the end portions of the stringers or other deck-board supporting components. The cap portions are secured to the embraced portions beneath the deck-boards. Flanges may be provided on the cap portions at the end of the protective members for direct securement to the upper surface of the deck-boards and to the under surface of the underlying portion of the pallet. With pallets of block type construction, side protective members may be included to be nailed, screwed or otherwise secured to sides of the pallet, whereupon the periphery of the pallet is protected.

Other pallet protectors have been disclosed in the patent literature. For example, U.S. Pat. No. 4,292,899 (Steffen) discloses a protective element for a pallet in the form of a plate, preferably formed of sheet metal for a fixation to deleting stringer of the pallet. The plate-like element is preferably nailed to the pallet.

U.S. Pat. No. 5,076,175 (Whatley, II) also discloses a protective plate for use with a pallet. The plates may include perforations or holes to receive fasteners such as nails for fixing the plate to the pallet. The plates are disclosed as being fabricated from sheet metal.

U.S. Pat. No. 5,673,629 (Ginnow) discloses an end cap construction for protecting the ends of the stringers of a pallet. Each of the end cap construction units is a generally U-shaped member having plural apertures therein.

In my U.S. Pat. No. 6,192,807, there is disclosed a pallet protector assembly arranged for use with a conventional pallet, e.g., a wooden pallet having a plurality of stringers disposed generally parallel to one another between upper and lower decks formed of plural spaced-apart deck-boards. The pallet has a pair of sides and a pair of ends. The pallet protector assembly comprising plural, e.g., four, elongated bar-like, hollow plastic, guard members, each which has an opposed pair of end portions. Each end portion of each guard member includes a respective connector. Both of the connectors of two of the guard member are bulbous key-like projections. Both of the connectors of the other two of the guard members are mating key-slot shaped recess. The bulbous key-like projections of the two guard members are arranged to be releasably received within respective recesses of the other two guard member to releasably secure the guard members to one another to form a self-supporting frame encircling the periphery of the pallet. The connectors forming the guard members are resistant to accidental disconnection from each other so that the protector assembly when in place is resistant to accidental disconnection. However, any guard member can be readily purposely removed from the others to provide access to any portion of the pallet, e.g., access to an end portion to enable the pallet to be lifted by the tines of a conventional fork-lift machine.

In my co-pending U.S. patent application Ser. No. 09/519,300, filed on Mar. 6, 2000, now U.S. Pat. No. 6,234,086 entitled Protector for an Array of Pallets there is disclosed and claimed a pallet protector assembly for use with an array of pallets, e.g., at least two conventional pallets arranged in an array closely adjacent each other. Each of the pallets has a plurality of stringers disposed generally parallel to one another underneath an upper deck. The deck is formed of plural spaced-apart deck-boards. Each of the pallets also has a pair of sides and a pair of ends. The pallet protector assembly comprising at least six elongated bar-like guard members, each of which has a first end portion and a second end portion. The first end portion includes a first connector. The second end portion includes a second connector. The first connector of any one of the guard members is arranged to be releasably secured to the second connector of any other of the guard members. All of the guard members are arranged to be secured to each other to form a self-supporting frame for encircling the periphery of the array of pallets, with the guard members being resistant to accidental disconnection from each other.

In my co-pending U.S. patent application Ser. No. 09/808,916, filed on Mar. 15, 2001, now U.S. Pat. No. 6,408,770 entitled Adjustable Pallet Protector Assembly For A Single Pallet Or An Array Of Pallets, whose disclosure is incorporated by reference herein, there is disclosed a pallet protector assembly for use with one or an array of plural conventional pallets. The pallet protector assembly comprising plural, e.g., at least four, elongated bar-like, hollow plastic, guard members. Each guard member is composed of a first section and a second, with each section having an exposed end portion. The first and second sections of each guard member are telescopically slidably coupled together, whereupon the length of the guard member can be adjusted. The first end portion of the first section includes a first connector, e.g., a male member. The second end portion of the second section includes a second connector, e.g., a mating female connector. The connectors of each of the guard members are arranged to be releasably securable to the connectors of the other guard members form a self-supporting frame for encircling the periphery of the pallet(s), with the guard members being resistant to accidental disconnection from each other.

While the pallet protector assemblies of my aforementioned patent and co-pending patent application overcome many of the drawbacks of the prior art pallet protecting devices, they still leave something to be desired from the standpoint of protecting persons from injury and/or protecting items located on the pallet.

SUMMARY OF THE INVENTION

This invention relates to a corner protector system for use with at least one pallet, e.g., a single pallet or an array of plural pallets, about which a pallet protector assembly is disposed. The pallet(s) with which the subject invention may be used can be conventional, e.g, a rectangular or square shaped assembly having a pair of sides and a pair of ends, with plurality of stringers disposed generally parallel to one another underneath an upper deck, with the deck being formed of plural spaced-apart deck-boards. The pallet protector basically comprises at least four elongated guard members which are releasably coupled together at respective corners to form a self-supporting frame for encircling the periphery of the pallet(s).

The corner protector comprises a hollow member having a pair of walls disposed at an angle to each other to form a corner. Each of the walls includes a bottom portion having a longitudinally extending channel. The recesses merger to form a right angled channel arranged to releasably receive an associated corner of the pallet protector therein, whereupon the walls of the corner protector extend upward from the pallet protector to protect any item located on the pallet adjacent the corner of the pallet.

In accordance with one preferred embodiment of the invention each of the corner protectors is formed of a light-weight, impact resistant material, such as polyethylene, polyolefin cellulose composite, or other plastics, and is arranged to be mounted on the pallet protector corner by that corner snap-fitting into the right angled channel.

DESCRIPTION OF THE DRAWING

FIG. 4 is a side elevation view of the bottom of the corner member shown in FIGS. 2 and 3; and FIG. 5 is an enlarged sectional view taken along line 5—5 of FIG. 4.

DETAILED DESCRIPTION OF THE PREFERRED EMBODIMENT

Figure 1:
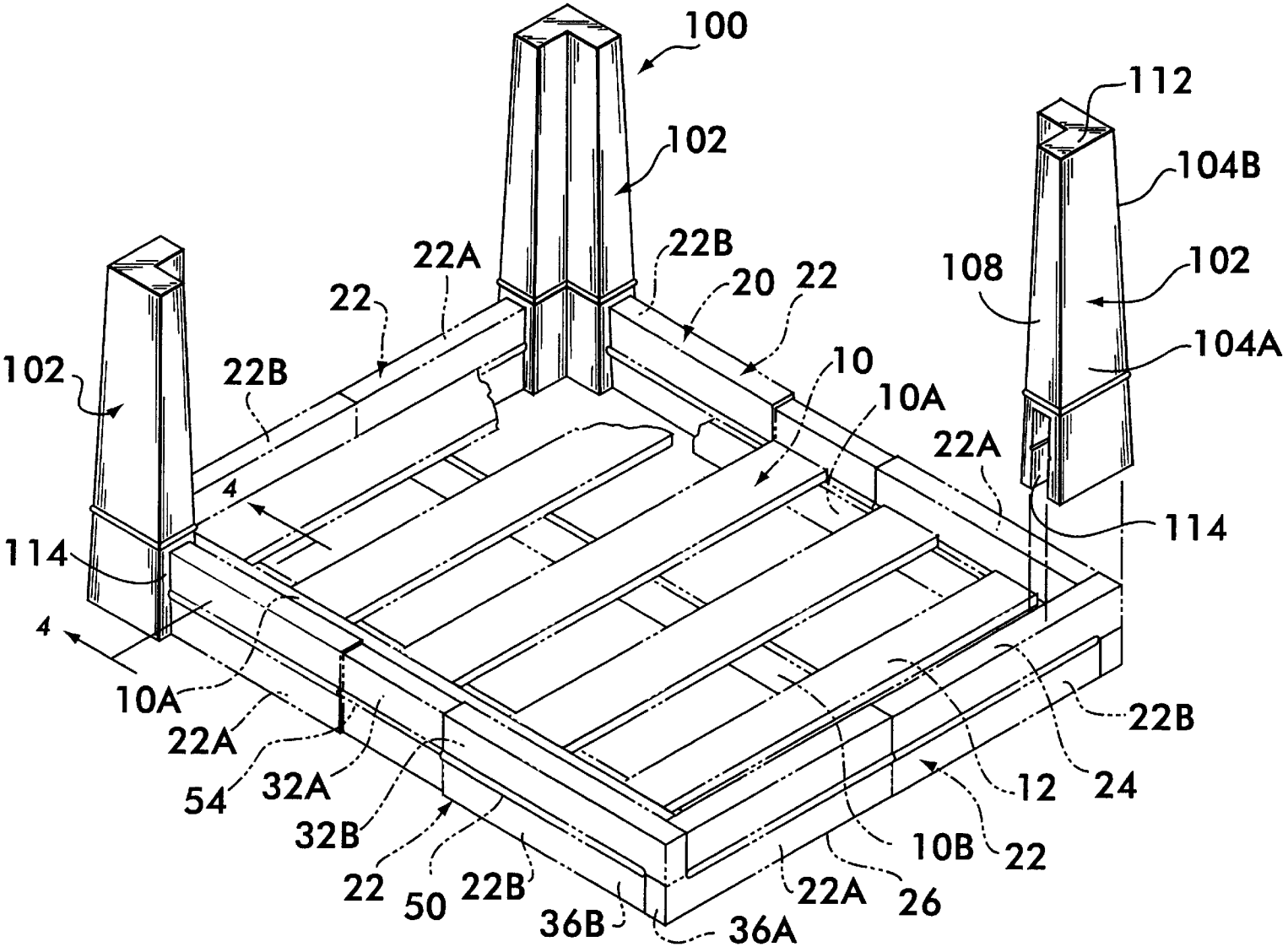
FIG. 1 is an isometric view of a corner protector system constructed in accordance with this invention being shown located on an adjustable pallet protector assembly, like that disclosed in my aforementioned copending patent application Ser. No. 09/808,916, that is disposed about the periphery of a conventional pallet, e.g., a single faced, flush-stringer wooden pallet.

Referring to FIG. 1 there is shown at 100 a corner protector system constructed in accordance with this invention for use with a pallet protector assembly 20 mounted about the periphery of a conventional pallet 10. The system 100 basically comprises a modular set of components, i.e., plural corner protector members (to be described later), which are arranged to be releasably secured to respective corners of the pallet protector assembly 20, when that assembly is assembled and in place forming a peripheral wall surrounding the pallet 10.

The pallet protector assembly 20 is preferably constructed in accordance with the teachings of my aforementioned patent application Ser. No. 09/808,916. To that end, as will be described in some detail later, the assembly 20 includes plural extendable guard members arranged to be connected together at respective corners to form a protective wall encircling the pallet 10. When that wall is place it protects the pallet from injury which could otherwise result from the pallet being impacted by some piece of machinery, e.g., a fork-lift truck, or other object. Moreover, the pallet protector 20 also serves to protect personnel and others in the vicinity of the pallet from being injured by contact with the pallet, e.g., being injured by a splinter from the pallet.

Before discussing the corner protector assembly 100 of this invention, a brief description of the details of the pallet 10 and of the pallet protector assembly 20 is in order. To that end as can be seen in FIG. 1 the pallet 10 may be of a single-face, flush-type stringer design, or a reversible or double-faced, flush-type stringer design (not shown). A single faced pallet includes plural, e.g., two, parallel outer stringers 10A and a central stringer 10B. The three stringers are elongated bar-like members disposed parallel and equidistantly to one another. The outer stringers define the two opposed sides of the pallet, with their respective ends defining the two opposed ends of the pallet. The stringers disposed under and support an upper deck 12 made up of a plurality of spaced-apart deck-boards. The deck-boards are fixedly secured to stringers by nails, screws, or other suitable fasteners. When so connected, the upper deck and the stringers 10A and 10C cooperate to define the a pair of side-by-side, lengthwise extending, open-ended passages for receiving the tines of the fork of a fork-lift truck for facilitating load handling. In the embodiment of FIG. 1 the passageways have no bottom wall since there is no lower deck.

The pallet 10 is typically formed of wood, but may be formed of any durable, wear-resistant, load-supporting material. Examples of such other materials are plastics, metals, etc. As will be appreciated by those skilled in the art, conventional pallets 10 like those described above, while relatively low in cost and easy to fabricate, suffer from various disadvantage. The most significant disadvantages exist if the pallets are formed of wood, since such pallets tend to splinter or break relatively easily. This action may not only result in damage to the pallet to the extent at which it is no longer functional, but also could subject personnel who may come in contact with the pallet to injury from splinters. The pallet protector of this invention, while suitable for use on any type of pallet is particularly suitable for use with prior art wooden pallets to minimize, if not prevent, damage to pallet itself and to prevent splinter-induced injuries to personnel by shielding them from the sides and ends of the pallet.

The pallet protector assembly 20 basically comprises a plurality, e.g., at least four, elongated, rails or guard members. In an embodiment of the assembly for use with a single pallet 10 the assembly 20 includes four rails or guard members 22. The guard members are each of identical construction and each includes two hollow, elongated sections 22A and 22B which are arranged to be slidably coupled, e.g., telescoped, together at their inner end portions (as will be described later). This feature enables each guard member to be adjusted in size from its minimum length state up to its maximum length state. In the minimum length state, the inner ends of the two sections 22A and 22B are telescoped together (overlapped) to the maximum extent possible. The maximum length state is that wherein the inner ends of the two sections 22A and 22B are telescoped together to the minimum extent possible. The two sections 22A and 22B can be adjusted to any intermediate position between the minimum overlap to the maximum overlap so that the guard member can be adjusted to any length from its maximum length to its minimum length.

As best seen in FIGS. 4 and 5 each of the sections 22A and 22B has a top wall 24, a bottom wall 26, an inside wall 28, an outside wall 30. All of the walls of each section extend the entire length of the section parallel to the central longitudinal axis of the section. The cross sectional shape the section 22B taken along a plane transverse to the central longitudinal axis is rectangular and is constant along the entire length of the section. The cross sectional shape the section 22A taken along a plane transverse to the central longitudinal axis is the same rectangular shape and size as the section 22B and is constant along the entire length of the section 22A except for its inner end portion 32A. In particular, the inner end portion 32A is rectangular but of a slightly lesser size to enable the inner end portion of section 22A to be slidably received closely within the inner end portion 32B of section 22B. When the inner end 32A of the section 22A is located within the inner end 32B of the section 22B and at its deepest penetration, i.e., the orientation wherein the length of the section 22 is the shortest, the outer surfaces of all of the walls of the section 22A are flush with the outer surfaces of the corresponding walls of the section 22B.

In order to strengthen each guard member and to ensure that when assembled the guard member is resistant to bending or other deformation each of the inner and outer walls 28 and 30, respectively, of the section 22B include a longitudinally extending ridge/groove 50 extending virtually the entire length of the section halfway between the top and bottom walls 24 and 26, respectively. The inside surface of the ridge/groove 50 forms a track for receipt of a ridge 54 of the section 22A. The ridge 54 extends along the outer surface of the inside and outside walls 28 and 30, respectively, of the section 22A and is located halfway between the top and bottom walls, 24 and 26, respectively, of that section. Each ridge 54 includes two portions. One portion extends the length of the inner end portion 32A of each of the inner and outer walls 28 and 30, respectively, of the section 22A. The other portion is the remainder of that guard member section 22A. The radius of curvature of the ridge portion at the inner end of the guard member section 22A is sufficiently small to enable it to fit within the groove of the ridge/groove 50 in the inner and outer walls 28 and 30, respectively, of the guard member section 22B. The radius of curvature of the remaining portion of the ridge 54 (that is the portion not making up the inner end portion 32A) is the same as that of the outer surface of the ridge/groove 50 of the section 22B. Each ridge portion at the inner end of the guard member 22A is arranged to be received within a respective groove 50 of the inside and outside walls of the section 22B to help guide the sliding of the two sections 22A and 22B with respect to each other. Like the ridges 50, the ridges 54 provide resistance to deformation of the section 22A.

Each of the sections 22A and 22B can be formed of any suitable material, two particularly suitable ones being polyethylene and polyolefin cellulose composite, but other plastics or other non-plastic materials can be used as well so long as they are somewhat light in weight, durable, and impact resistant.

Each of the guard members 22 is arranged to be located on a respective side or end of the pallet when the assembly is used with only a single pallet. The two sections making up each guard member can be adjusted with respect to each other to customize the length of the guard member to that of the size of the side or end of the pallet along which the pallet guard will extend.

The guard members are arranged to be releasably connected together at their respective ends 36A and 36B so that all of the guard members can be connected together to form a hollow rectangular frame for encircling the periphery of the pallet 10 or of an array of pallets. To that end, the outer end of the section 22A of each guard member includes a respective female connector element (not shown) in the form of a cylindrical hole or bore located on a ledge (not shown) adjacent the end wall 36A. The outer end of the section 22B of each guard member includes a male connector element in the form of a cylindrical pin (not shown) located on a ledge (not shown) adjacent the end wall 36B. The pin terminates in a tapered free end and is of substantially the same outside diameter as the inside diameter of each of the female connector elements or bores to enable any pin to be matingly received therein to releasably connect the two guard members composed of those mating connector members to each other at a corner, thereby forming a rectangular, self supporting frame assembly.

When the guard members are connected as just described they form a rectangular, self supporting frame assembly or wall having four corners. The wall completely encircles and covers the ends and sides of the pallet, thereby protecting the pallet from impact-induced damage. If the pallet is formed of wood or some other material which may tend to splinter, the assembled protector assembly 20 will prevent any person from coming in contact with the sides or ends of the pallet, thereby protecting the person from being injured by a splinter from the pallet.

In order to provide access to either end of the pallet to expose it's tine receiving open-ended passages so that the tines of the fork of a fork-lift truck or a pallet jack may be inserted therein to lift or otherwise move the pallet, either of the guards 22 located across the respective ends of the pallet can be readily removed, leaving the remaining guards assembled, if desired.

The corner protector system 100 of this invention serves to provide additional protection from injury to persons in the vicinity of the pallet 10, while also providing some measure of protection to items, e.g., merchandise, that may be disposed on the pallet. Moreover, by virtue of their size an orientation, each of the corner protector members of the system 100 provide a relatively large, viewable surface area above the plane of the pallet, which may serve to carry any type of indicia, e.g., advertising or promotional materials, logos, warnings, etc. Thus, the corner protector system 100 of this invention has particular utility in those environments where numerous persons may be exposed to pallets bearing items or merchandise, e.g., warehouses, discount stores, manufacturing facilities, etc.

The corner protector system 100 can include up to four corner members 102 for releasable securement to any or all of the four corners of an assembled pallet protector 20. In the embodiment shown in FIG. 1 only three corner protectors 102 are shown. That is merely exemplary.

Figure 2:
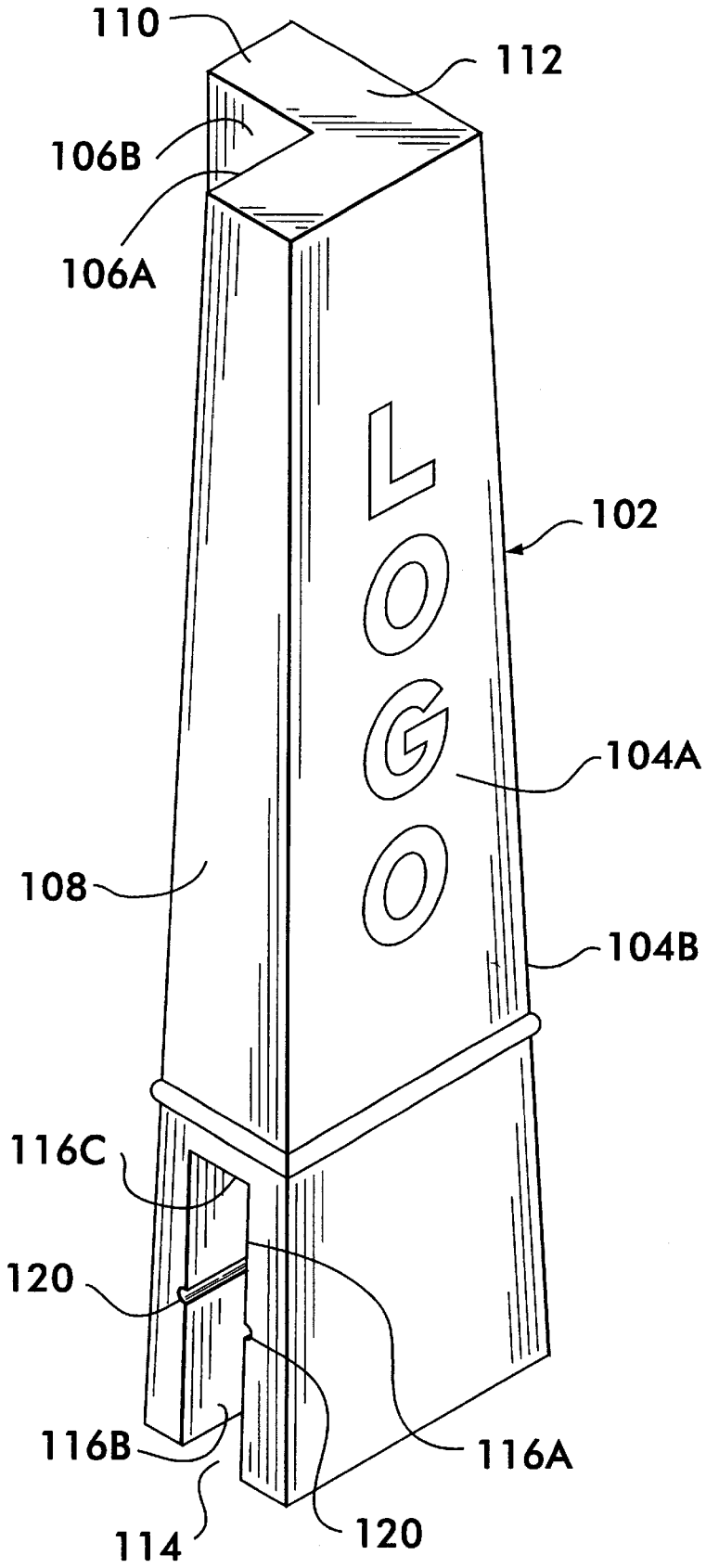
FIG. 2 is an enlarged isometric view of the outside face of one of the corner protector members of the corner protector assembly shown in FIG. 1.
Figure 3:
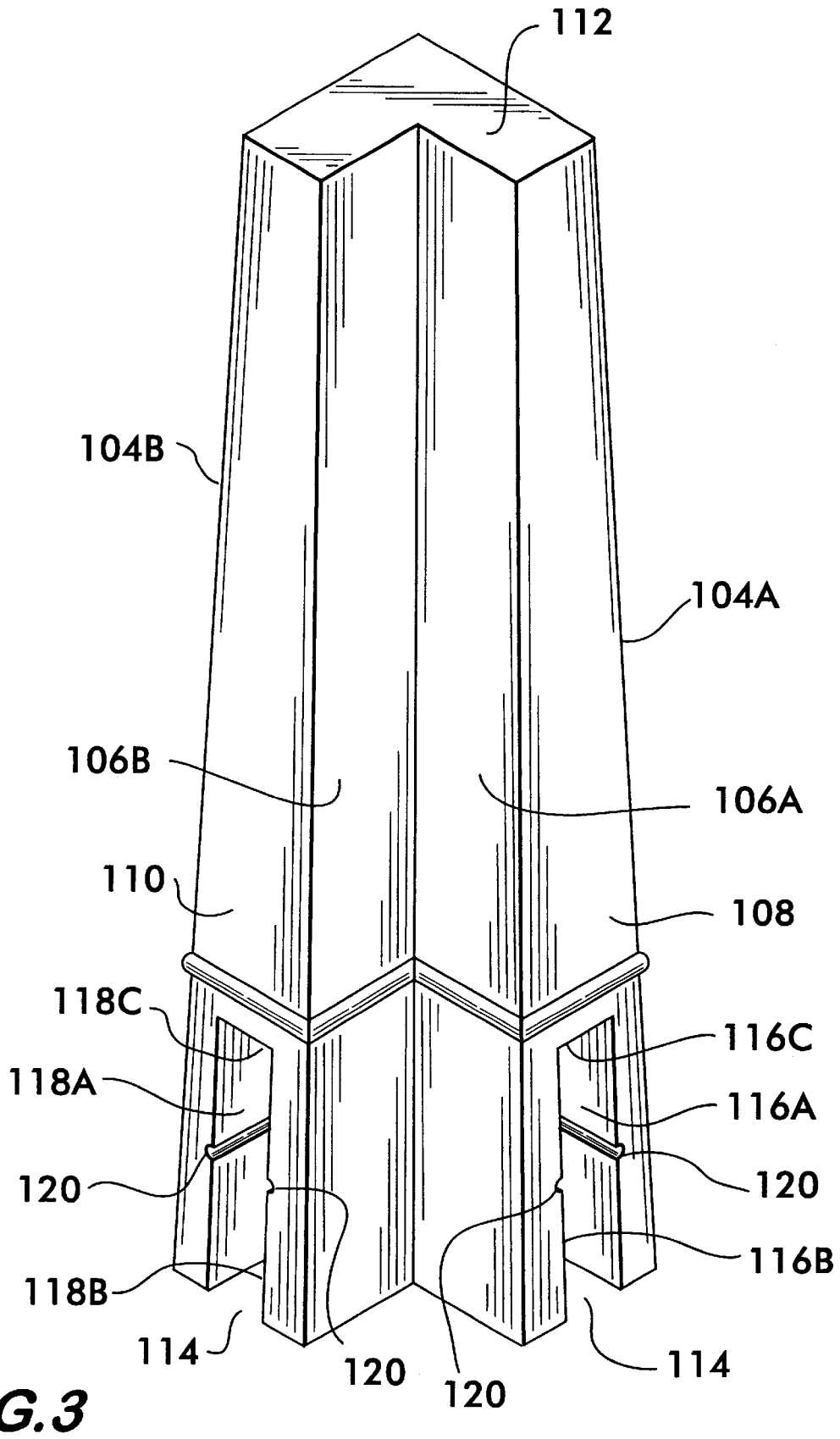
FIG. 3 is an enlarged isometric view, similar to FIG. 2, but showing the inside face of the corner protector member.

The details of the construction and operation of the corner protector system will now be described. Each of the corner members 102 is of identical construction and basically comprises a hollow, unitary member molded of a impact resistant plastic, like that used for the pallet guards 22. One particularly useful plastic is polyethylene. As best seen in FIGS. 1–3, each corner member 102 is of a slightly upward tapering L-shape that includes two generally planar outer walls 104A and 104B, two generally planar inner walls 106A and 106B, a pair of generally planar end walls 108 and 110, and a top wall 112. The walls 104A and 104B form the outer surface or face of the member 102 and while each tapers upward slightly, the angle between the walls measured at any horizontal plane will be 90 degrees to form an outside corner face. The inner walls 106A and 106B of the member 102 each extend vertically and are disposed perpendicularly to each other to form the inside surface or face of the corner. The end wall 108 extends upward at a slight angle to the vertical between the outer wall 104A and the inner wall 106A. In a similar manner the end wall 110 extends upward at a slight angle to the vertical between the outer wall 104B and the inner wall 106B. The top wall is located between the upper ends of the walls 104A, 104B, 106A, 106B, 108 and 110.

Each corner member includes a corner-shaped channel 114 in its lower end to accommodate any corner of an assembled pallet protector 20. In particular the channel 114 is made up of pair of legs which are disposed at right angles to each other. One of the legs of the channel 114 is made up of a first pair of generally planar, vertically oriented inner walls 116A and 116B and a top wall 116C. The other of the legs of the channel 114 is made up of a second pair of generally planar vertically oriented inner walls 118A and 118B and a top wall 118C. The inner walls 116A and 116B of the first leg of the channel are located between the outer wall 104A and the inner wall 106A, while the top wall 116C of that leg of the channel is located between the top of the walls 116A and 116B. In a similar manner the inner walls 118A and 118B of the other leg of the channel are located between the outer wall 104A and the inner wall 104B, while the top wall 118C of that other leg of the channel is located between the top of the walls 118A and 118B. Each leg of the channel 114 is open at its outer end, i.e., at end walls 108 and 110, and is also open at its inner end, i.e., the point at which the two legs of the channel merge.

The spacing between the inner walls 116A and 116B of the first leg of the corner shaped channel 114 is such that it will closely accommodate the outer and inner walls 30 and 28, respectively, of any guard member 22 therein. Moreover, the height of the walls 116A and 116B is just slightly greater than the height of any guard member. Accordingly the end of any guard member can be fully received within that leg of the channel 114. In a similar manner, the spacing between the inner walls 118A and 118B of the other leg of the corner shaped channel 114 is such that it will closely accommodate the outer and inner walls of any guard member 22 therein. Moreover, the height of the walls 118A and 118B is just slightly greater than the height of any guard member. Accordingly the end of any guard member can be fully received within that other leg of the channel 114. Since the legs of the channel 114 are disposed perpendicularly to each other, the connected ends (i.e., the corner) of any two guard members 22 can be received within the channel.

Inasmuch as the guard members 22 of the pallet protector 20 include the heretofore identified ridges/grooves 50/54, horizontally disposed linear recesses 120 are provided in the walls 116A, 116B, 118A and 118B of the two legs of the corner shaped channel 114 to enable the guard members to be accommodated within the channels 114 without interference from the ridges/grooves 50/54. To that end the channels 120 are correspondingly shaped to the outer surfaces of the ridges 50/54 and are located at the same height from the bottom of the guard member 102 that the ridges 50/54 are located from the bottom of the each guard member 22.

Since the walls making up each corner member 102 are formed of plastic, the wall portions contiguous with the corner shaped channel at the bottom of the member can flex slightly with respect to each other so that the walls 116A and 116B can separate somewhat to accommodate the walls 28 and 30 of and guard member therebetween, with the ridges 50/54 of the guard member snap-fitting into the recesses to enhance the securement between the corner member and the pallet protector guard members 120. All that is required to releasably mount a corner member 102 onto any corner of an assembled pallet protector 20 is to align the legs of the corner shaped channel 114 over the corner of the pallet protector and to press downward on the corner member. This action releasably mounts the corner member in place resistant to displacement as shown in FIG. 1. Removal of the corner member 102 from the pallet protector is readily accomplished by merely pulling up on the corner member to release it from the pallet protector, i.e., to enable the ridges 50/54 to exit the recesses 120.

In the interest of aesthetics each corner member 102 is provided with a horizontal ridge 122 extending about the periphery of the walls 104A, 104B, 106A, 106B, 108 and 110 at a location just above the top of the corner shaped channel 114. Other surface ornamentation may be provided in the interest of aesthetics, if desired. Moreover, the plastic material making up each corner protector member may be colored in the interest of aesthetics or to render the corner protector more visible. Further still the corner protector may include any indicia on it, like the logo 124 shown in FIG. 2.

In accordance with a preferred embodiment of this invention each corner protector is approximately 23 inches (58.4 cm.) high, with the length of the face walls 104A and 104B measured along the bottom edge being approximately 5.5 inches (14 cm.) long, and with the width of the end walls 108 and 110, also measured along the bottom edge, being approximately 3 inches (7.6 cm.). The ridge 122 is located at approximately 6 inches (15.2 cm.) above the bottom edge of the corner member. Accordingly, when a corner member is mounted on the pallet protector it will extend upward approximately 17 inches (43.2 cm.) above the top of the pallet protector (and the pallet as well). This renders it highly visible to persons in the vicinity. Moreover, by extending upward that distance it will provide significant protection from impact induced damage to any merchandise located adjacent that corner of the pallet.

As should be appreciated from the foregoing the corner protector system of this invention makes use of simple plastic members or fittings which snap on the corners of an assembled pallet protector. While the pallet protector serves to hide the wood pallet(s) about which it is disposed, the corner protectors of the system of this invention give added protection to customers and employees and to the merchandise disposed on the pallet. For example, the corner protectors should reduce injuries due to accidents, such as those resulting from persons, e.g., employees or customers, tripping over or walking into a pallet. Moreover, their construction renders them resistant to impact-induced damage and hence they should exhibit a long, useful life. Their snap-fit securement means enables the corner protectors to be readily mounted or dismounted from the pallet protector. Moreover, they can be used on any size pallet run or a continuous run of pallets. The large surface area of the corner protectors render them ideal for accommodating store logos or other indicia, e.g., address identification. Since the protectors are made of plastic they can be of any desired color or surface appearance in the interest of aesthetics or visibility.

It should be pointed out at this juncture that the shape, size and construction of corner protectors of this invention can be varied according to the application for which they are to be used. Moreover, while the corner protector system has been shown and described for particular use with the adjustable pallet protector of my aforementioned copending patent application Ser. No. 09/808,916, it should be clear that the system can be used with any type of pallet protector assembly, e.g., those of my other applications and patents, whether adjustable or not, so long as the pallet protector includes members which are connected to each other at corners to encircle the pallet.

Without further elaboration the foregoing will so fully illustrate my invention that others may, by applying current or future knowledge, adopt the same for use under various conditions of service.

I claim:

1. A corner protector system comprising at least one corner protector for use with at least one pallet about which a pallet protector assembly is disposed, the pallet protector assembly comprising at least four elongated guard members which are releasably coupled together at respective corners to form a self-supporting frame for encircling the periphery of the at least one pallet, said at least one corner protector comprising a hollow member having a pair of exterior outside walls disposed at an angle to each other to form an exterior outside corner, a pair of exterior inside walls disposed at an angle to each other to form an exterior inside corner and a pair of exterior end walls connecting said exterior outer and inner walls, said corner protector including a bottom portion having two enclosed longitudinally extending channels therein, each of said channels comprising an interior inside wall, an interior outside wall and an interior top wall, each of said channels being linear and open at an associated exterior end wall, said channels merging to form a right angled internally-located channel arranged to releasably receive an associated corner of the pallet protector therein said guard members extending through an associated one of said exterior end walls, said exterior walls of said at least one corner protector extending upward from the pallet protector to protect any item located on the pallet adjacent the corner of the pallet.

2. The corner protector system of claim 1 wherein said system comprises four corner protectors.

3. The corner protector system of claim 1 wherein said at least one corner protector is formed of a light-weight, impact resistant material.

4. The corner protector system of claim 3 wherein said material is selected from the group consisting of polyethylene, polyolefin cellulose composite, or other plastics.

5. The corner protector system of claim 1 wherein said at least one corner protector is arranged to be mounted on the pallet protector corner by snap-fitting into said right angled channel.

6. In combination a corner protector system and a pallet protector assembly for use with at least one pallet about which a pallet protector assembly is located, said pallet protector assembly comprising at least four elongated guard members which are arranged to be releasably coupled together at respective corners to form a self-supporting frame for encircling the periphery of the at least one pallet, said corner protector system comprising at least one corner protector comprising a hollow member having a pair of walls disposed generally perpendicularly to each other to form a corner, each of said walls including a bottom portion having a longitudinally extending channel therein, said channels merging to form a right angled channel arranged to releasably receive an associated corner of said pallet protector assembly therein, whereupon said walls of said at least one corner protector extend upward from said pallet protector assembly to protect any item located on the pallet adjacent the corner of the pallet.

7. The combination of claim 6 wherein said pallet protector assembly comprising at least four elongated guard members, each of said guard members comprising a first hollow section and a second hollow section, said first hollow section having a first end portion, said second hollow section having a second end portion, said first and second sections being telescopically slidably coupled together, whereupon the length of said guard member can be adjusted, said first end portion of said first section including a first connector, said second end portion of said second section including a second connector, said connectors of said guard members being releasably securable to one another to form a self-supporting frame for encircling the periphery of the at least one pallet, with said guard members being resistant to accidental disconnection from each other.

8. The combination of claim 7 wherein each of said sections of each of said guard members includes a longitudinally extending rib.

9. The combination of claim 8 wherein said at least one corner protector is arranged to be mounted on the pallet protector corner by snap-fitting into said right angled channel.

10. The combination of claim 9 wherein said at least one corner protector and said pallet protector assembly each are formed of a light-weight, impact resistant material, such as polyethylene, polyolefin cellulose composite, or other plastics.

* * * * *